US008109550B1

(12) United States Patent
Benjamin et al.

(10) Patent No.: US 8,109,550 B1
(45) Date of Patent: Feb. 7, 2012

(54) PACK END TOOL

(75) Inventors: Eric Gregg Benjamin, Carmel, IN (US); Masahiko Minamikawa, Columbus, IN (US); Toshihide Tanaka, Indianapolis, IN (US); John Campbell, East Liberty, OH (US); David Wayne Hicks, Shelbyville, IN (US)

(73) Assignees: Honda Motor Co., Ltd., Tokyo (JP); Midwest Express Inc., East Liberty, OH (US)

( * ) Notice: Subject to any disclaimer, the term of this patent is extended or adjusted under 35 U.S.C. 154(b) by 666 days.

(21) Appl. No.: 12/240,865

(22) Filed: Sep. 29, 2008

(51) Int. Cl.
*B66C 1/42* (2006.01)

(52) U.S. Cl. ..... 294/110.1; 294/67.31; 294/117

(58) Field of Classification Search ..... 294/67.31, 294/110.1, 110.2, 117, 81.51, 81.61
See application file for complete search history.

(56) References Cited

U.S. PATENT DOCUMENTS

| | | | | |
|---|---|---|---|---|
| 3,261,637 | A | | 7/1966 | Bopp et al. |
| 3,306,646 | A | * | 2/1967 | Flora, Jr. ..... 294/2 |
| 3,695,667 | A | | 10/1972 | Dempsey |
| 3,899,205 | A | | 8/1975 | Lanigan et al. |
| 4,105,240 | A | | 8/1978 | Steenson et al. |
| 5,338,150 | A | * | 8/1994 | Focke et al. ..... 414/799 |
| 6,062,620 | A | * | 5/2000 | Walker et al. ..... 294/67.31 |
| 6,257,636 | B1 | | 7/2001 | Hovis et al. |
| 6,474,711 | B2 | | 11/2002 | Kazerooni et al. |
| 7,086,677 | B2 | | 8/2006 | Boe et al. |
| 7,090,068 | B2 | | 8/2006 | Matsuo |

* cited by examiner

*Primary Examiner* — Saul Rodriguez
*Assistant Examiner* — Gabriela Puig
(74) *Attorney, Agent, or Firm* — Standley Law Group LLP

(57) ABSTRACT

Exemplary embodiments provide a grasping and lifting device for moving a plurality of different-sized containers. The device contains a set of clamps which securely attach to a plurality of different-sized containers and allow them to be quickly lifted and relocated by an operator. A toggle device may also be used to hold the clamps in the open position for added security and efficiency. A hoisting device with a translating mechanism provides lift and motion assistance to the operator so that the risk of repetitive motion injury is reduced.

17 Claims, 3 Drawing Sheets

PACK END TOOL

CROSS-REFERENCE TO RELATED APPLICATIONS

This application is a non-provisional patent application and does not claim priority to any applications.

TECHNICAL FIELD

Exemplary embodiments relate generally to a device for grasping and lifting various containers.

BACKGROUND AND SUMMARY OF EXEMPLARY EMBODIMENTS

In large assembly plants, the movement of materials and subassemblies around the plant can be a critically important task to the overall function of the plant. Each station on the assembly line must have an adequate supply of materials so that the line is not stopped in order to re-stock any individual stations. If the line must be stopped, the plant is losing efficiency, and with a loss of efficiency ultimately comes a loss of money.

However, a large volume of parts cannot be stored at each station for a number of reasons. First, there may be a lack of space within the assembly area of the plant to store any parts. Secondly, purchasing and storing a large back-stock of assembly materials may be a waste of precious capital, especially when parts may sit in storage for several weeks before actually being assembled. The demands of the modern assembly plant have created several streamlined material distribution methods. One method of note is 'just in time' (JIT) manufacturing. When practicing this type of distribution method, parts must move quickly from the supplier's factory to the final assembly line with little time and space wasted in between. In a large assembly plant which produces a high volume of outgoing products, moving thousands of parts around to hundreds of different workstations can be a daunting task.

In order to accomplish this, new ways of packaging parts to be assembled must be developed and corresponding methods for quickly sorting and moving these packaged parts must also be realized. Several problems exist however with current distribution systems. First, the size of assembly parts may vary widely, thus necessitating a different size and shaped container for each group of parts. For example, a day's supply of 3 mm nuts for attaching a small component may be much smaller than a day's supply of motor subassemblies. Thus, any distribution and sorting system must be able to accommodate a variety of different-sized containers. Secondly, when a plurality of different-sized containers move along a guided rail or roller system, the spacing between the containers may vary widely. Gaps between the containers may vary between several feet and several inches, and some containers may abut against one another leaving no gap whatsoever.

Modern assembly plants also pay close attention to the stress and strain that is put on the plant workforce. Most notably, injury from repetitive motions must be reduced or eliminated to ensure that a trained workforce may continue to work and not be forced to miss work due to a repetitive motion injury. Therefore, any distribution system must account for these concerns and place the smallest amount of stress on a worker as possible. Lift-assist devices have become popular, allowing a worker to lift and move a heavy object with very little bodily stress or risk of injury.

The exemplary embodiments herein allow a worker to grasp a variety of different containers, whether they are immediately next to one another or spaced widely apart. The device allows a plurality of containers to be used, from somewhat small to awkward and large, which allows the suppliers to package their parts in the most appropriate and efficient container for the application. Further, exemplary embodiments allow a worker to quickly grasp, lift, and move large containers with very little stress on their body.

The exemplary embodiments herein disclosed are not intended to be exhaustive or to unnecessarily limit the scope of the embodiments. The exemplary embodiments were chosen and described in order to explain the principles so that others skilled in the art may practice the embodiments. Having shown and described exemplary embodiments, those skilled in the art will realize that many variations and modifications may be made to affect the described invention. Many of those variations and modifications will provide the same result and fall within the spirit of the exemplary embodiments. It is the intention, therefore, to limit the embodiments only as indicated by the scope of the claims.

BRIEF DESCRIPTION OF THE DRAWINGS

A better understanding will be obtained from a reading of the following detailed description and the accompanying drawings wherein identical reference characters refer to identical parts and in which.

DETAILED DESCRIPTION OF PREFERRED EMBODIMENTS

Figure 1:
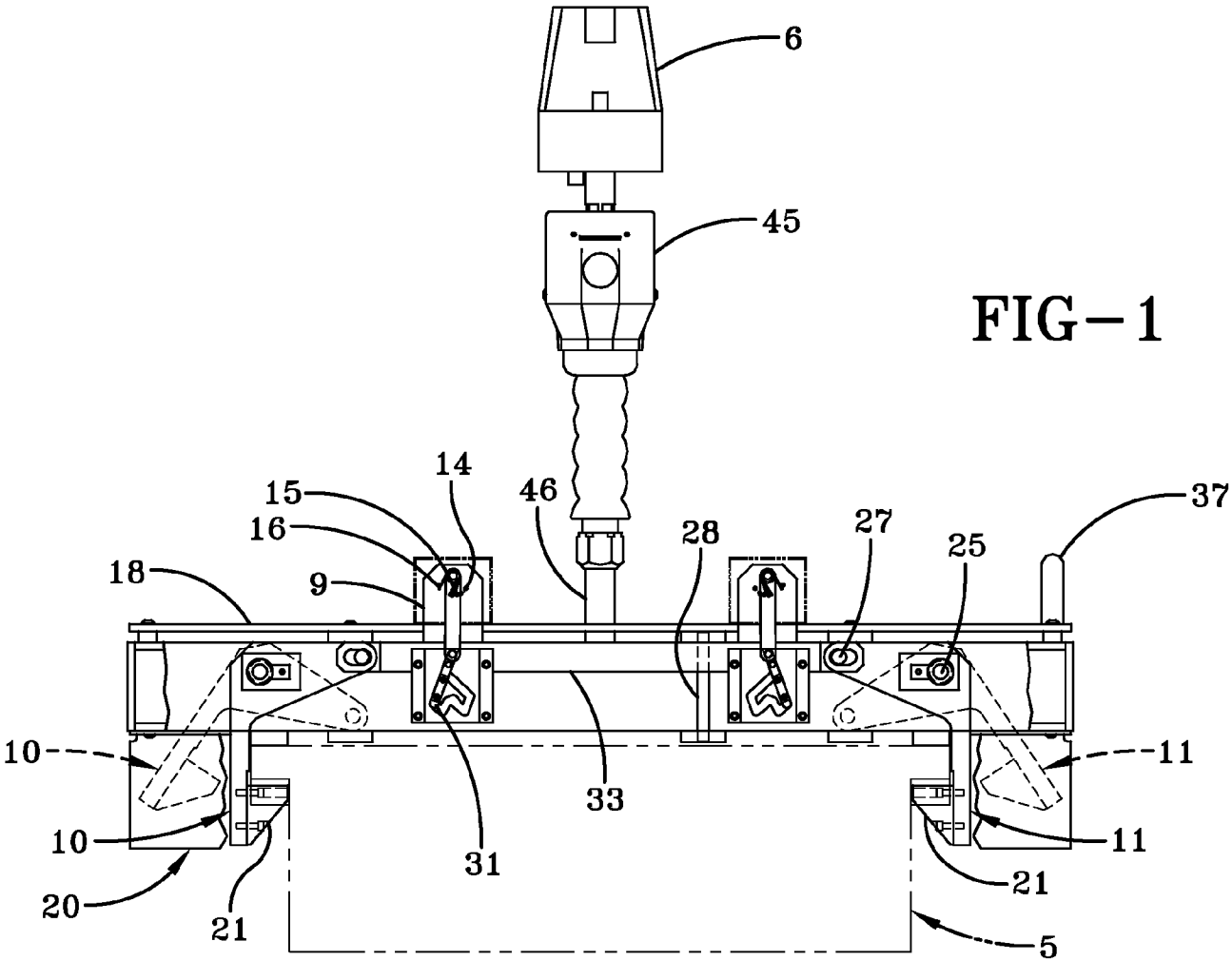
FIG. 1 is a front view of an exemplary embodiment.

In FIG. 1, two clamps 10 and 11 are shown in both the closed and open positions. Notably, the dashed lines indicate clamps that are 'open' and the solid lines indicate clamps that are 'closed.' The closed clamps 10 and 11 are shown as engaging a container 5. Each clamp may rotate on a pivot shaft 25. The opening and closing of the clamps may be caused by the upward and downward movements of the link 33. The link 33 may be connected to the clamps using pin 27. The link 33 may be moved through upward and downward movements of the extension 46, which is controlled by actuator 45. A dowel guide 28 may be used to guide the link 33. Directly above the actuator is the connection 6 to the hoisting device (not shown). Thus, when the actuator engages the hoisting device and begins an upward movement of the extension, it causes the link to be raised and the clamps 10 and 11 to close. The opposite would apply when the hoisting device lowers the grasping mechanism. Thus, when the container and grasping device are lowered and touch a surface, the extension 46 will begin to move down which in turn moves the link 33 down which in turn opens the clamps 10 and 11. The grasping device can therefore be engaged by the same actuating movements that cause the hoist to raise and lower the grasping device and container. Therefore, the entire movement is faster and more secure since the container can be engaged and raised in a simultaneous motion. The same is true for the lowering and dis-engaging of the container.

Two toggle mechanisms are also shown which hold the clamps open every other cycle. It should be noted that exemplary embodiments may contain only one toggle mechanism or may alternatively contain a plurality of toggle mechanisms. These toggle mechanisms hold the clamps open every other time the device is raised so that a container may be released. Therefore, when the device is raised for the first time, the clamps close on a container. When the device is raised for the second time, the clamps remain open so that a container may be released.

An exemplary toggle mechanism may contain one or more of the following parts: a dowel 14, long spring pin 15, short spring pin 16, arm block 9, and a leaf spring 31. The top guard 18 is shown as the top surface of the device. The top guard 18 protects the user from injury by keeping the user's extremities and clothing from becoming caught in the clamps, links, or other associated mechanisms. The top guard 18 may be transparent, so that the user can properly align the clamps with containers. A transparent plastic or Plexiglas material may be suitable for the top guard 18.

The frame 20 encases many of the moving mechanisms and also prevents the user's extremities and clothing from becoming caught in the clamps, links, or other associated mechanisms. Each clamp contains lifting lugs 21 which engage with features in the container 5 to both lift the container and stabilize the container while it is being transported. Handle 37 may be used by the operator to position the device and transport the container.

Figure 2:
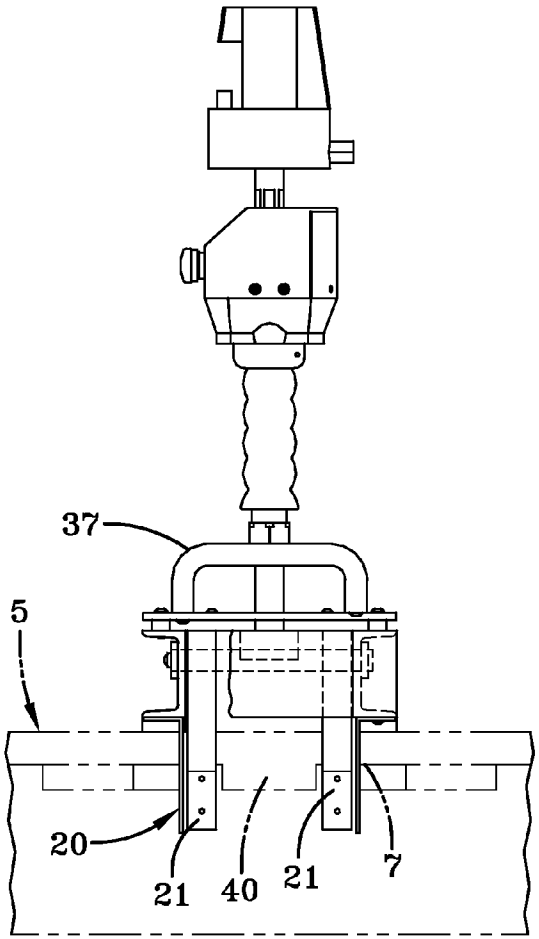
FIG. 2 is a side view of an exemplary embodiment.

FIG. 2 shows the interaction between the lifting lugs 21 and the stabilizing features 40 of container 5. When the clamps close, the lifting lugs 21 surround the stabilizing features 40 of the container 5 in order to stabilize the container once it has been lifted by the hoisting mechanism. The lifting lugs 21 also interacting with the lifting ledge 7 of the container. Upward pressure by the lifting lugs 21 on this lifting ledge 7 results in the container being lifted off of the conveyer, cart, or other transport device.

Figure 3B:
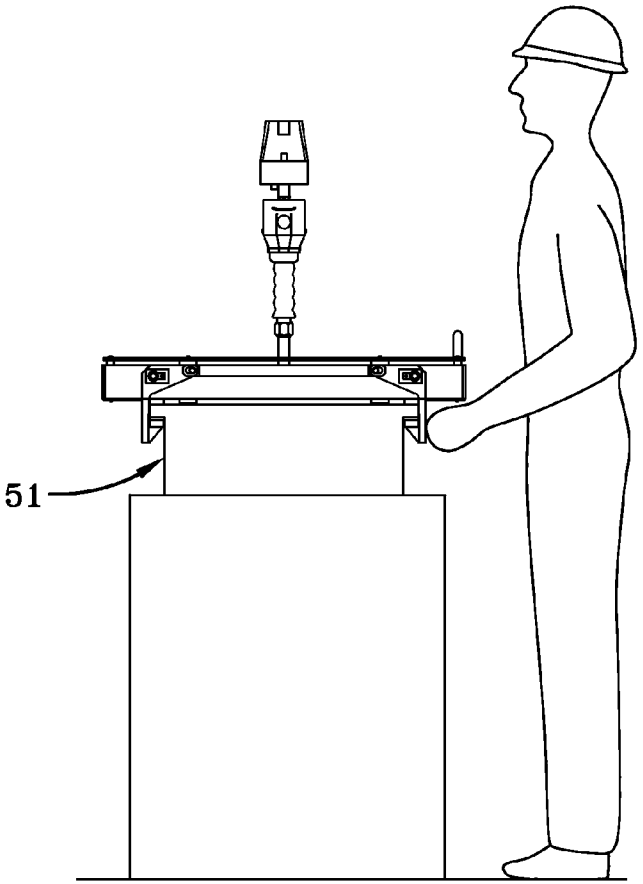
FIGS. 3A and 3B are front views of an exemplary embodiment showing compatibility with containers of different heights.
Figure 3A:
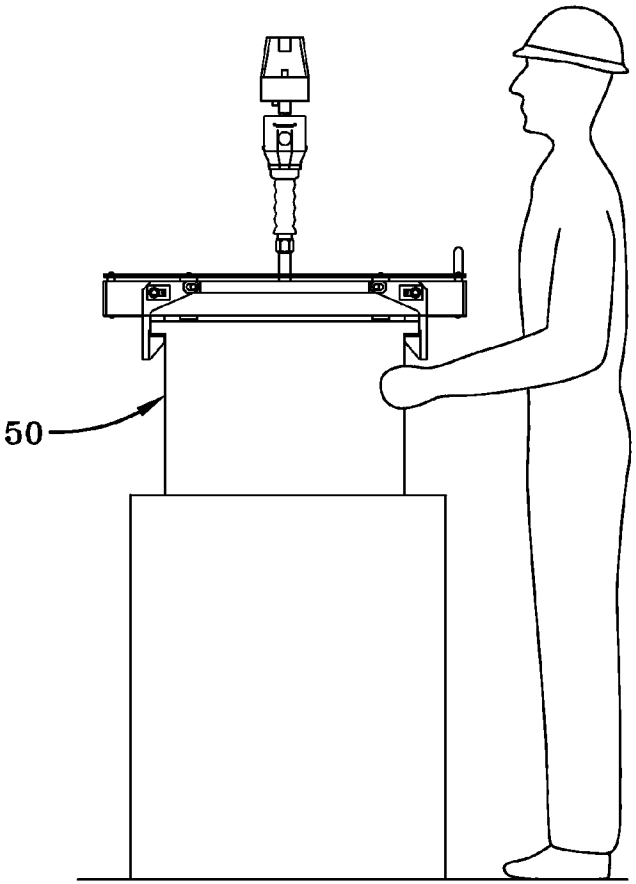

FIGS. 3A and 3B show the relative position of the operator and the device. Further, FIG. 3A is shown with container 50 which is significantly taller than container 51 which is shown in FIG. 3B. The device is compatible with containers of any desired height. Further, it should be noted that each container may have a similar width dimension so as to remain compatible with the dimensions of the clamps, while both the depth of the container and the height of the container may vary widely.

It should be noted that the position of the operator in FIGS. 3A and 3B is not necessarily the desired operating position. For example, during typical operation of the device, the operator may have one hand on the handle 37 (shown in FIGS. 1 and 2) and the other hand on the actuator 45 or the area directly underneath the actuator (shown in FIGS. 1 and 2). This operator position is simply used to illustrate the relative position of the device and the operator and the resulting small amount of stress that would be put on the operator during operation of the device.

It should be noted that the hoisting device has not been shown in any of the figures. Embodiments can contain any number of different types and styles of hoisting devices, including but not limited to bridge cranes, jib cranes, and intelligent lifting devices. An exemplary embodiment might utilize an I-beam jib crane. Exemplary hoisting devices are commercially available from Corbel, Inc. in Fishers, N.Y. www.gorbel.com.

It should be recognized that containers are only constrained in the width dimension for the containers larger than 24" and length dimension for container less than 24". For example, containers may be virtually any depth and any height and may still be compatible with the exemplary embodiments. This flexibility in container size allows suppliers to package and ship parts in the most appropriate containers for both the supplier and the end assembly plant. Further, an operator can select any container and slide, lift and relocate it, without having to take containers in the order that they come through the conveyor or roller system. Only a small amount of stress would be place on the operator's body, as the lifting is assisted by a hoisting device and any translational movements may be assisted by a translating mechanism. This translating mechanism could be any type of rotating arm or boom and possibly in combination with any type of sliding movement on wheels or bearings. No time must be taken to re-size the dimensions of the grasping mechanism for any specific container, which allows the operator to move a variety of different-sized containers in a short amount of time. The clamps provide a very stable connection between the device and container such that large and/or heavy containers can be quickly moved without fear of dropping the container or spilling its contents.

Having shown and described preferred embodiments, those skilled in the art will realize that many variations and modifications may be made to affect the described embodiments and still be within the scope of the claims. Thus, many of the elements indicated above may be altered or replaced by different elements which will provide the same result and fall within the spirit of the claimed embodiments. It is the intention, therefore, to limit the invention only as indicated by the scope of the claims.

What is claimed is:

1. A device for grasping containers comprising:
a frame;
a link attached to the frame and vertically slidable relative to the frame into an up position and a down position;
a pair of clamps pivotably and slidably attached to the link such that the up position of the link corresponds to a closed position of the clamps and the down position of the link corresponds to an open position of the clamps; and
a toggle mechanism connected to the link and having a spring which holds the link in the down position during alternate down positions.

2. The grasping device of claim 1 wherein:
the spring is a leaf spring.

3. The grasping device of claim 1 further comprising:
a hoisting device attached to the link which causes the link to slide relative to the frame.

4. The grasping device of claim 1 further comprising:
a pair of lifting lugs attached to each clamp.

5. The grasping device of claim 1 further comprising:
an operator handle attached to the frame.

6. The grasping device of claim 1 further comprising:
a dowel guide attached to the frame and passing through the link.

7. The grasping device of claim 1 further comprising:
a top guard attached to the frame.

8. A device for grasping and lifting containers with stabilizing features having a pair of opposing side surfaces, the device comprising:
a frame;
a link attached to the frame and vertically slidable relative to the frame into an up position and a down position;
a pair of clamps pivotably and slidably attached to the link such that the up position of the link corresponds to a closed position of the clamps and the down position of the link corresponds to an open position of the clamps;
a toggle mechanism connected to the link and having a spring which holds the link in the down position during alternate down positions;

a hoisting device connected to the link for causing the link to slide relative to the frame; and a pair of lifting lugs attached to each clamp which are adjacent to the pair of opposing side surfaces of the stabilizing features when the clamps are in the closed position.

9. The grasping and lifting device of claim 8 further comprising:

an extension attached between the link and the hoisting device; and an actuator which causes the hoisting device to raise and lower the extension.

10. The grasping and lifting device of claim 8 wherein:

the spring is a leaf spring.

11. The grasping and lifting device of claim 8 further comprising:

an operator handle attached to the frame.

12. The grasping and lifting device of claim 8 further comprising:

a dowel guide attached to the frame and passing through the link.

13. A system for handling containers of various sizes, the system comprising:

a plurality of containers comprising:

substantially similar width dimensions;

stabilizing features having opposing surfaces with substantially similar dimensions;

varying depth and height dimensions;

a grasping device comprising:

a frame;

a link attached to the frame and vertically slidable relative to the frame into an up position and a down position;

a pair of clamps pivotably and slidably attached to the link such that the up position of the link corresponds to a closed position of the clamps and the down position of the link corresponds to an open position of the clamps;

a toggle mechanism connected to the link and having a spring which holds the link in the down position during alternate down positions;

an extension attached to the link;

a pair of lifting lugs attached to each clamp which are adjacent to the pair of opposing side surfaces of the stabilizing features when the clamps are in the closed position; and a hoisting device connected to the extension for lifting and lowering the grasping device and causing the link to slide relative to the frame.

14. The container handling system of claim 13 wherein:

the spring is a leaf spring.

15. The container handling system of claim 13 further comprising:

a dowel guide attached to the frame and passing through the link.

16. The container handling system of claim 13 further comprising:

a transparent top guard attached to the frame.

17. The container handling system of claim 13 further comprising:

a horizontal lifting ledge on each container;

wherein the lifting lugs are adjacent to the lifting ledge of the containers when the clamps are in the closed position.

* * * * *